US006337533B1

(12) United States Patent
Hanashi et al.

(10) Patent No.: US 6,337,533 B1
(45) Date of Patent: Jan. 8, 2002

(54) SPARK PLUG FOR INTERNAL COMBUSTION ENGINE AND METHOD FOR MANUFACTURING SAME

(75) Inventors: Ken Hanashi, Nagoya; Keiji Kanao, Chita-gun; Tsunetoshi Goto, Kariya, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/324,860

(22) Filed: Jun. 3, 1999

(30) Foreign Application Priority Data

Jun. 5, 1998 (JP) ..... 10-157846
Jul. 21, 1998 (JP) ..... 10-205472

(51) Int. Cl.[7] ..... H01T 13/20; H01T 13/32
(52) U.S. Cl. ..... 313/141; 313/144; 313/140
(58) Field of Search ..... 313/118–145; 445/7, 35, 46, 49

(56) References Cited

U.S. PATENT DOCUMENTS 4,670,684 A * 6/1987 Kagawa et al. ..... 313/141
4,771,210 A 9/1988 Möhle
5,461,210 A * 10/1995 Matsutani et al. ..... 219/121.64
5,461,276 A * 10/1995 Matsutani et al. ..... 313/141
5,502,351 A * 3/1996 Katoh et al. ..... 313/141
5,574,329 A * 11/1996 Kagawa ..... 313/141
5,811,915 A * 9/1998 Abe et al. ..... 313/141
5,856,724 A * 1/1999 Chiu et al. ..... 313/141
5,977,695 A * 11/1999 Osamura et al. ..... 313/141
5,982,080 A * 11/1999 Shibata et al. ..... 313/141
6,078,129 A * 6/2000 Gotou et al. ..... 313/141
6,093,071 A * 7/2000 Osamura et al. ..... 445/7
6,121,719 A * 9/2000 Matsutani et al. ..... 313/141
6,147,441 A * 11/2000 Osamura ..... 313/141

FOREIGN PATENT DOCUMENTS

| | | |
|---|---|---|
| GB | 2 302 367 | 1/1997 |
| JP | 4-104491 | 4/1992 |
| JP | 8-298178 | 11/1996 |
| JP | 9-7733 | 1/1997 |

* cited by examiner

*Primary Examiner*—Ashok Patel
*Assistant Examiner*—Karabi Guharay
(74) *Attorney, Agent, or Firm*—Nixon & Vanderhye PC

(57) ABSTRACT

In a spark plug, a chip made of Ir alloy is partly buried into and bonded by laser beam welding on the ground electrode made of Ni base alloy. A molten portion is extended from the inside of the ground electrode through a junction of the chip and the electrode into the inside of the chip, but not formed on the spark discharge surface of the chip. Where A is a maximum length from the end of the junction on the side of the center electrode to the end of the molten portion on the junction on the side opposite to the center electrode, within the length A, B is a length of both ends of the molten portion, t is a length of the chip perpendicularly extending from the junction and d is a sum of the length t and a length of the molten portion protruding from the junction into the ground electrode, a ratio of A/B is not less than 0.5 and a ratio of d/t is not less than 2, but more than 4. When an end surface of the chip is the spark discharge surface, laser beam welding is conducted from the ground electrode toward a side of the other end surface or from the longitudinal side surface of the chip toward the ground electrode.

13 Claims, 11 Drawing Sheets

SPARK PLUG FOR INTERNAL COMBUSTION ENGINE AND METHOD FOR MANUFACTURING SAME

CROSS REFERENCE TO RELATED APPLICATION

This application is based upon and claims the benefit of priority of Japanese Patent Applications No. H.10-157846 filed on Jun. 5, 1998 and No. H.10-205472 filed on Jul. 21, 1998, the contents of which are incorporated herein by reference.

BACKGROUND OF THE INVENTION

1. Field of the Invention

The present invention relates to a spark plug for internal combustion engine provided with a noble metal chip bonded on a center and/or ground electrode, in particular, a life time improvement of the bonding strength of the chip.

2. Description of Related Art

A spark plug has generally a center electrode fitted through an insulator into a housing and a ground electrode integrated with the housing. The portion of the center electrode exposed out of the end of the insulator faces the ground electrode to form a spark gap within which a spark is discharged. To improve the life time and the performance of the spark plug, a noble metal chip is bonded on the center and/or ground electrode to constitute a spark discharge spot for the spark gap.

Conventionally, a platinum (Pt) alloy has been widely used as material for the noble metal chip. However, the Pt alloy has a demerit that the consumption resistance thereof is presumed not to be sufficient to meet more severe engine specifications for vehicles in future. Therefore, the use of the iridium (Ir) alloy having a melting point higher than that of the Pt alloy has been recently studied and an iridium-rhodium (Ir—Rh) alloy and the like have been proposed, as shown in JP-A-9-7733.

In case of the Pt alloy chip, resistance welding has been employed in general for bonding the chip and the center and/or ground electrode in view of easy fabrication and inexpensive cost. However, material of the center and/or ground electrode on which the chip is bonded is usually a nickel (Ni) base alloy and the difference between the linear expansion co-efficient of the Ni alloy and that of the Ir alloy is larger than the difference between that of the Ni alloy and that of the Pt alloy. Therefor, if the spark plug having the Ir alloy chip bonded on the electrode by the resistance welding is used in a high temperature combustion chamber, a great thermal stress produced at the junction of the chip and the electrode due to the above mentioned larger difference of the linear expansion co-efficient may cause a crack or separation of the junction of the chip and the electrode and, as the worst case, the chip may be left out from the electrode.

When the chip made of the Ir alloy is bonded on the electrode, a laser beam welding is considered to be preferable to limit the possible separation of the chip and the electrode during the life time because the chip and the electrode may be sufficiently molten due to the high density of its energy. If an alloy containing Ni and Ir is sufficiently constituted as a molten portion extending from the junction of the chip and the electrode to both sides of the chip and the electrode, the reliable bonding strength of the junction can be secured as the thermal stress may be absorbed and alleviated.

However, the Ni and Ir alloy molten portion tends to be constituted not uniformly but locally so that the bonding strength quality may be lowered. In particular, the laser beam welding of the chip on the ground electrode has an inherent difficulty for effectively bonding all around the periphery of the chip, without bonding a spark discharge surface of the chip, by rotating the ground electrode over the fixed laser beam radiating device because of the L shape construction that the ground electrode extending from the housing surrounding the outer periphery of the center electrode is vended to face a leading end of the center electrode. The laser beam welding of the chip before having bonded the electrode on the housing will also bring the same difficulty.

Further, according to the conventional embodiment as described in U.S. Pat. No. 4,771,210, the ground electrode was provided with a bore penetrating from the surface on the side of the discharge gap to the opposite surface into which the pin-shaped noble metal chip is inserted and is caulked in or welded to the ground electrode on the rear side by laser or argon, to secure the fixing of the chip on the ground electrode. However, it is presumed to be not good at productivity to provide the bore on the electrode because an extreme accuracy is required for fabricating the bore, while the molten portion is not formed on the spark discharge surface of the chip.

SUMMARY OF THE INVENTION

The present invention has been made in view of the above mentioned problem, and an object of the present invention is to provide a spark plug for internal combustion engines having an Ir alloy chip bonded on a Ni base alloy center and/or ground electrode by the laser beam welding, in which the molten portion has a reliable bonding strength against the thermal stress.

It is one of the aspect of the present invention to have a construction that the chip is bonded on a surface of the leading end of the ground and/or center electrodes to form a molten portion, but the molten portion is not formed on the spark discharge surface of the chip.

As shown in FIG. 3, the molten portion (70) constituted by an alloy containing Ni and Ir extends from the inside of the chip (52) through the junction (60) of the chip (52) and the electrode (3 or 4) somewhat deep into the electrode (3 or 4). How the molten portion is shaped is important, in particular, how many length the molten portion occupies to the length of the junction of the chip and the electrode and how deep the molten portion is protruded into the electrode are important factors. A ratio of B/A is preferably not less than 0.5, where A is a maximum length from the end (61) of the junction (60) on the side of the center electrode to the end (72) of the molten portion on the junction (60) on the opposite side to the center electrode and, within the length A, B is a length of both ends (71 and 72) of the molten portion.

Further, it is preferable that a ratio of d/t is not less than 2, but not more than 4, where t is a length of the chip (52) perpendicularly extending from the junction (60) and d is a sum of the length t and a length of the molten portion (70) protruding from the junction (60) into the ground electrode (4).

Unless the ratio of B/A is less than 0.5, the separation of the chip from the electrode due to the thermal stress may be prevented. Further, unless the ratio of d/t is less than 2, the separation of the molten portion from the electrode due to the thermal stress may be prevented because the molten portion contains more than 20 weight percent of Ir as an Ir and Ni alloy and, unless the ratio of d/t is more than 4, the separation of the molten portion from the chip due to the thermal stress may be prevented because the molten portion contains less than 80 weight percent of Ir as Ir and Ni alloy.

Another aspect of the present invention is to provide a construction that a longitudinal side surface of the pillar chaped chip is bonded on an end surface, an inner surface or end surface of the leading end of the ground electrode or on an end surface of the center electrode so that the end surface of the chip may constitute a spark discharge surface.

Further aspect of the present invention is to provide a spark plug for internal combustion engines having a relatively small sized noble chip bonded on a ground electrode in which the laser beam is applied from the outer surface of the leading end of the ground electrode to constitute a molten portion extending from the ground electrode into an inside of the chip. The spark plug according to the present invention can be manufactured at the inexpensive cost because the amount of the noble metal to be used is minimized and the bore in the ground electrode as shown in the conventional spark plug mentioned above is not necessary.

To manufacture the above mentioned spark plug, the chip may be fixed tentatively on a surface of the electrode by resistance welding and, then, bonded by laser beam welding so as to constitute a molten portion, which makes the laser beam welding easy.

Further, according to the embodiments of the present invention, as the molten portion, which is not good at the consumption resistance, is not formed on the spark discharge surface of the chip, the longer life and higher performance of the spark plug may be realized.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
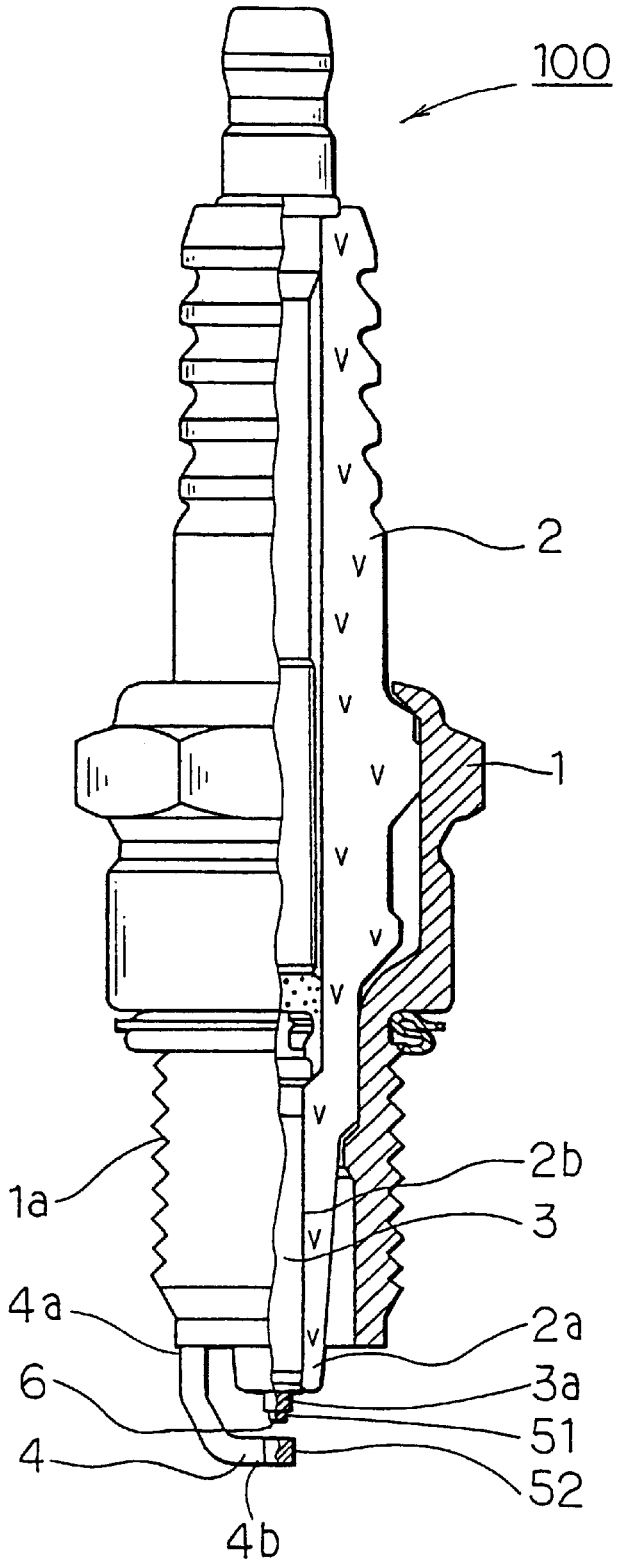
FIG. 1 is a semi cross sectional view of a spark plug according to a first embodiment of the present invention.

FIG. 1 shows a semi cross sectional view of a spark plug for an internal combustion engine according to a first embodiment of the present invention. The spark plug has a tubular housing 1 having a thread 1*a* for mounting to an engine cylinder block (not shown). An insulator 2 made of alumina ceramics ($Al_2O_3$) is fitted into the housing 1 and an end portion 2*a* of the insulator 2 is exposed out of the end of the housing 1.

A center electrode 3 is inserted and fixed at a through hole 2*b* of the insulator 2 so as to be held by and insulated with the housing 1 through the insulator 2. A leading end 3*a* of the center electrode 3 is exposed out of the end portion 2*a* of the insulator 2. The center electrode 3 is shaped as a column whose inner member is composed of metal material having good thermal conductivity such as copper and whose outer member is composed of metal material having good heat resistance and corrosion endurance such as Ni base alloy.

Figure 2A:
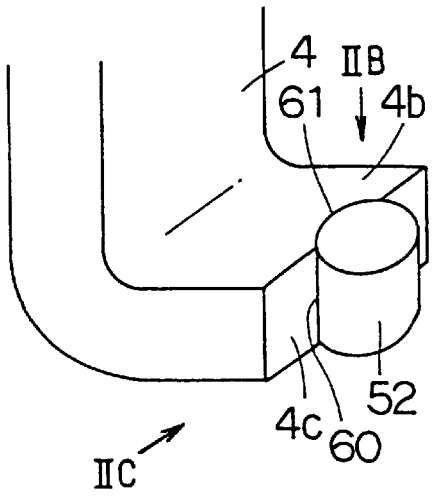
FIG. 2 A is a partly enlarged diagonal appearance view of FIG. 1 showing a portion of the ground electrode which faces the center electrode.
FIG. 2B is an appearance view taken from an arrow II B in FIG. 2A.
FIG. 2C is an appearance view taken from an arrow II C in FIG. 2A.
Figure 2B:
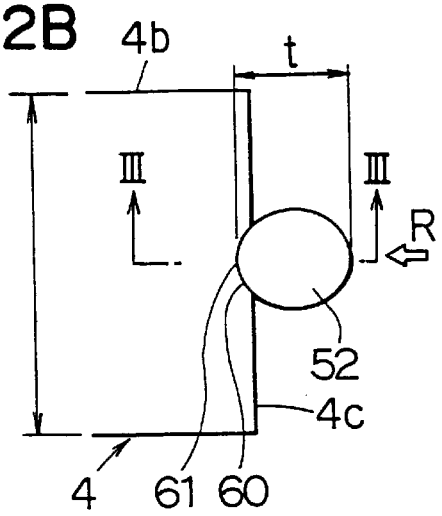
Figure 2C:
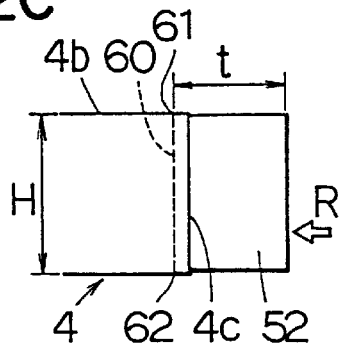

A fixed leading end 4*a* of a ground electrode 4 is fixed by welding at the end of the housing 1 and extends so as to be shaped nearly L. A leading end 4*b* opposite to the fixed leading end 4*a* faces the leading end 3*a* of the center electrode 3 with a gap 6 for spark discharge. FIG. 2A is a partly enlarged diagonal appearance view showing a leading end 4*b* of the ground electrode, FIG. 2B is an appearance view taken from an arrow IIB in FIG. 2A and FIG. 2C is an appearance view taken from an arrow IIC in FIG. 2A. The ground electrode 4 is composed of a Ni base alloy containing Ni as a basic composition (for example "Inconel", trademark) and is formed in about L shape by bending a square pillar having a flat shaped cross section (for example, the width W is 2.8 mm and the thickness H is 1.6 mm as shown in FIGS. 2A, 2B and 2C).

A column shaped noble metal chip 51 is bonded by laser beam welding on the leading end 3*a* of the center electrode 3. The chip 51 is bonded on an end surface of the leading end 3*a* of the column shaped center electrode 3*o*. On the other hand, a longitudinal side surface of a column shaped noble metal chip 52 is bonded by laser beam welding on an end surface 4c of the leading end 4*b* of the ground electrode 4. The chips 51 and 52 (correspond to electrode material for spark discharge) are made of an Ir alloy (for example, Ir-10Rh containing 90 weight percent Ir and 10 weight percent Rh). The discharge gap 6 is a space between the chips 51 and 52, for example, 1 mm.

Figure 3:
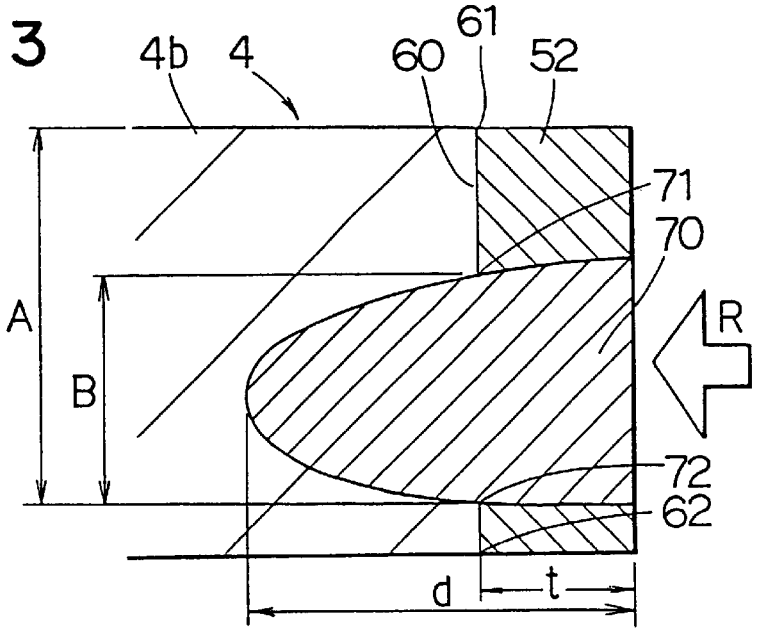
FIG. 3 is a cross sectional view taken along a line III—III in FIG. 2B.

With respect to the chip 52 that is a gist of the present embodiment, the details will be described below according to FIGS. 2A, 2B and 2C. The chip 52 is shaped as a column, the length of which is nearly same as the thickness H of the ground electrode 4. A part of the longitudinal side surface of the column is buried into the end surface 4*c* of the leading end 4*b*. The boundary between the side surface of the chip 52 and the end surface 4*c* of the leading end 4*b* constitute a junction 60. The welding appearance of the chip 52 and the ground electrode 4 at the junction 60 will be explained with reference to FIG. 3, which shows a cross sectional view taken along a line III—III in FIG. 2B, that is, a cross sectional view taken along the longitudinal center axis of the column shaped chip 52. In FIG. 3, the upper side is the side of the center electrode 3. The length of the line shown as the junction 60 is the same as the length of the column of the chip 52, that is, the thickness H of the ground electrode 4 (for example, 1.6 mm) in FIG. 3.

As the chip 52 and the ground electrode 4 are bonded by the laser beam welding, a molten portion 70 formed by melting both material of the chip 52 and the ground electrode 4 extends from the chip 52 through the junction 60 into the ground electrode 4 as described in a semi elliptical hatching portion in FIG. 3. An Ir and Ni alloy (Ir—Ni alloy) constitutes the molten portion 70, as the chip is made of the Ir alloy and the ground electrode 4 is made of the Ni base alloy as mentioned above.

The laser beams of the laser beam welding are radiated almost perpendicularly to the end surface 4*c* of the leading end 4*b* through the longitudinal center axis of the column shaped chip 52 as shown in an arrow R in FIGS. 2B, 2C and 3, respectively. Therefor, FIG. 3 shows the cross section taken along the line that is parallel to the center axis of the chip 52 and in which the laser energy is applied most intensively, that is, the cross section where the molten portion 70 is most widely formed at the junction 60.

"A" shown in FIG. 3 is the longest length (hereinafter called maximum length A) among the lengths of various straight lines connecting the end 61 of the junction 60 on the side of the center electrode 3 and the end 72 of the molten portion 70 on the junction 60 on the side opposite to the center electrode 3. "B" shown in FIG. 3 is a length of the molten portion 70(hereinafter called molten portion length B) within the maximum length A, that is, a length between the end 71 of the molten portion 70 on the side of the center electrode 3 and the other end 72 of the molten portion 70.

The junction 60 (first non-molten portion) between the end 62 of the junction 60 on the side opposite to the center electrode 3 and the end 72 of the molten portion 70 on the side opposite to the center electrode 3 and the junction 60 (second non-molten portion) between the other end 61 of the junction 60 and the other end 71 of the molten portion 70, the chip 52 and the ground electrode 4 are not molten, as shown in FIG. 3. The maximum length A is a length between both the ends 61 and 62 of the junction 60 excluding the length of the first non-molten portion. The first non-molten portion may not be always necessary for the present invention, though it is preferable that the first non-molten portion is provided in view of no existence of the molten portion near the spark discharge surface of the chip.

As FIG. 3 shows the cross section taken along the line in which the laser energy is most intensively applied, the melting length of the molten portion 70 extending from the junction 60 into the leading end 4*b* of the ground electrode 4 shows a longest melting length (hereinafter called maximum melting length). In FIG. 3, t is a length of the chip (hereinafter called protruding length t) perpendicularly protruding from the junction 60. According to the present embodiment, the protruding length t is nearly identical to the diameter of the column shaped chip 52 (for example, 0.7 mm). A sum of the protruding length t and the maximum melting length is d (hereinafter called sum length d). The protruding length t is a length protruding from the junction 60 on the extension of the maximum melting length(d-t).

According to the present embodiment, the dimensions of A, B, d and t are defined as shown below to ensure the bonding reliability. Namely, a ratio (B/A) of the maximum length A to the molten portion length B is not less than 0.5 and a ratio (d/t) of the extruding length t to the sum length d is not less than 2, but not more than 4.

Next, a method for bonding the chip 52 on the ground electrode 4 will be described. With respect to the method for manufacturing the spark plug according to the present embodiment, the method for manufacturing the portion other than mentioned above is well known and the explanation thereof will be omitted. The chip 52 is bonded in general by laser beam welding on the ground electrode 4 fixed in advance into the housing 1, but may be bonded before the ground electrode 4 is fixed into the housing 1.

Before conducting the laser beam welding, the chip 52 is tentatively bonded by resistance welding on the end surface 4*c* of the leading end 4*b* of the ground electrode 4 so that the movement of the chip 52 may be prevented on conducting the laser welding. A part of the chip 52 is buried into the end surface 4*c* of the leading end 4*b* at the stage of the tentative bonding mentioned above. For the easy installation of the chip 52, a prior arrangement like a groove or a hollow may be provided on the junction portion of the ground electrode 4. After the tentative bonding, the laser beam welding is conducted from the direction shown in the arrow R.

With respect to the laser beam welding conditions, for example, the energy is 33J (15 msec pulse width, 360 V charging voltage), the defocus is +2 mm (the focus point of the laser beam is deeper by 2 mm from the surface of the chip 52 where the beam is radiated) and the laser beam diameter is 0.4 mm. The molten portion 70 is formed, for example, by radiating continuously (for example 3 times) the laser beam under the conditions mentioned above. The diameter of the chip 52 (corresponds to the protruding length t according to the present embodiment) is not changed and keeps constant before and after the laser beam welding.

The reason why the laser beam is continuously radiated by dividing into several times is described below. As the laser beam is radiated from the side of the chip 52 as shown in the arrow R, if the energy of the laser beam is weak, base material of the ground electrode 4 can not be sufficiently molten and Ir composition included in the molten portion 70 increases and, if too strong, Ir alloy and base material of the ground electrode 4 flow all over the air. Therefor, to form the molten portion having material composition intermediate between those of the chip 52 and the ground electrode 4, the laser beam energy, the density of which is limited to some extend, is radiated several times so that the respective contents of the Ir composition and the Ni composition to be included in the molten portion may be gradually decreased and increased in every one time radiation of the laser beam.

The laser beam welding conditions including the repeating time of the laser beam radiation can be decided by examining in advance the relationships between the configurations of the molten portion 70 and the laser beam welding conditions. To examine the molten portion 70, the ground electrode 4 and the chip 52 after the laser beam welding are cut down to appear the cross section shown in FIG. 3 and each dimension of A, B, d and t of the molten portion 70 can be observed by a microscopic examination. Further, the composition content by percentage can be obtained by an analysis in use of an energy dispersion analysis equipment such as EDS.

Figure 4A:
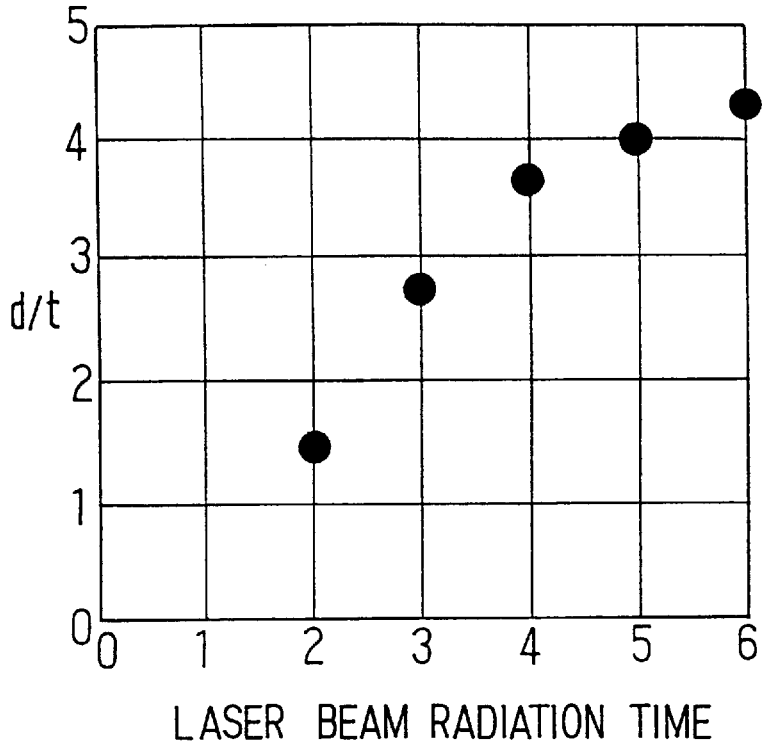
FIG. 4A is a graph showing the relationship between the laser beam radiation time and the ratio of d/t.
Figure 4B:
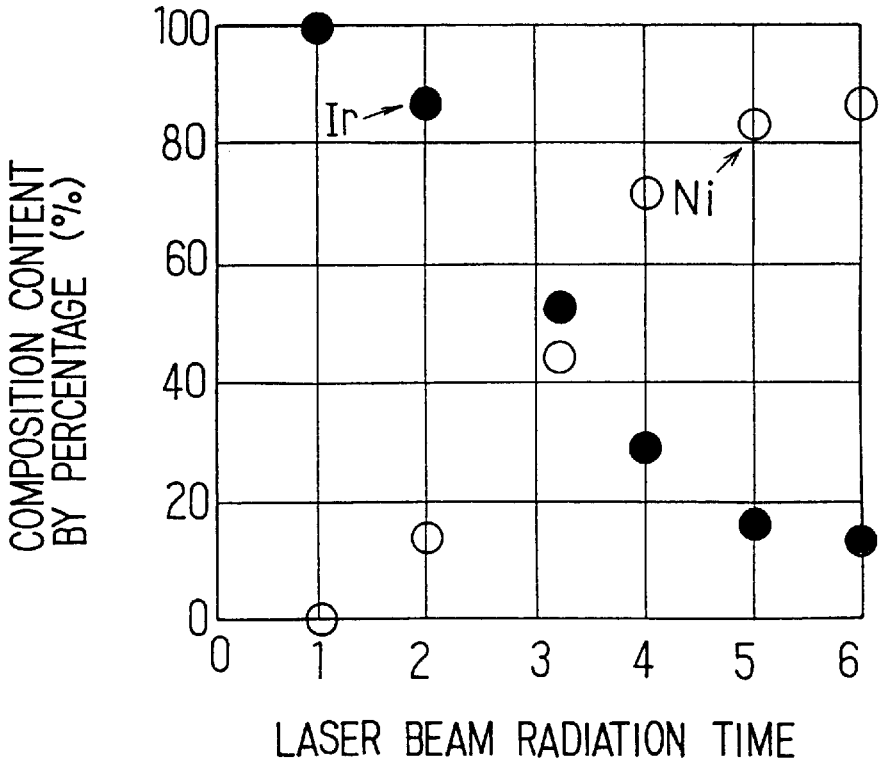
FIG. 4B is a graph showing the relationship between the laser beam radiation time and the Ir and Ni contents by percentage (%)

FIGS. 4A and 4B show, as examples, the examination results of the molten portion 70. FIG. 4A shows the relationship between the laser beam radiation time and the ratio of d/t under the laser beam welding conditions mentioned above. FIG. 4B shows the relationship between the laser beam radiation time and the Ni and Ir content by percentage (weight percent) under the presumption that the sum of the Ni weight percent and Ir weight percent included in the molten portion 70 is 100 weight percent. It will be understood that, according to the increase of the laser beam radiation time, the ratio of d/t increases and, further, Ni content increases and the Ir content decreases at the molten portion 70.

The bases on which each dimension of A, B, d and t at the junction portion of the chip 52 and the ground electrode 4 is defined as mentioned above are the experimental test results. To investigate the bonding strength of the chip 52, the chip 52 was made of Ir-10Rh and the protruding length t (diameter of the chip 52) was 0.7 mm. Under fixed conditions that the maximum length is 1.6 mm, the molten portion length is 1.0 mm and the ratio of E/A is 0.63, a plurality of samples having a variety of the maximum melting length (d-t) were made by changing the laser beam radiation time.

The endurance test on the samples was conducted in a 6-cylinder, 2000 cc engine operated during 100 hours with repetition of a cycle that an idling operation (about 300° C.) is kept for one minute and a full throttle operation (about 900° C.) of 6000 rpm for one minute. The bonding strength was evaluated by examining the separation appearance of the chip 52 with respect to the samples falling within the range from 1.5 to 5 as the ratio of d/t. The above endurance test results are described in FIGS. 5A and 5B.

Figure 5A:
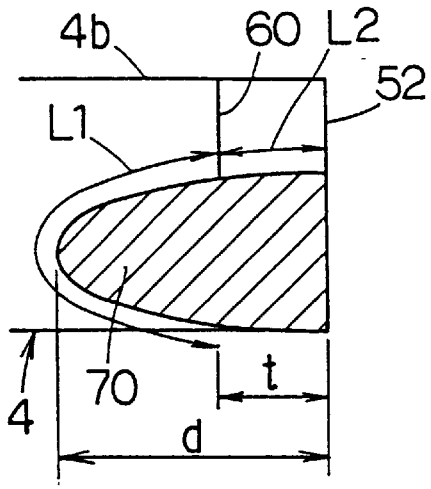
FIG. 5A is a drawing for explaining the definition of the electrode-molten portion junction L1 and the chip-molten portion junction L2.

As shown in FIG. 5A, L1 is a length of the junction between the ground electrode 4 and the molten portion 70 (electrode-molten portion junction) and L2 is a length of the junction between the chip 52 and the molten portion 70 (chip-molten portion junction). To examine the separation percentage at the respective electrode-molten portion junction and chip- molten portion junction, the microscopic examination was made to observe each of separation lengths L3 and L4 in each of L1 and L2. The separation percentage at the electrode-molten portion junction is represented as (L1–L3)/L1×100 (%) and the separation percentage at the chip-molten portion junction is represented as (L2–L4)/L2×100 (%).

Figure 5B:
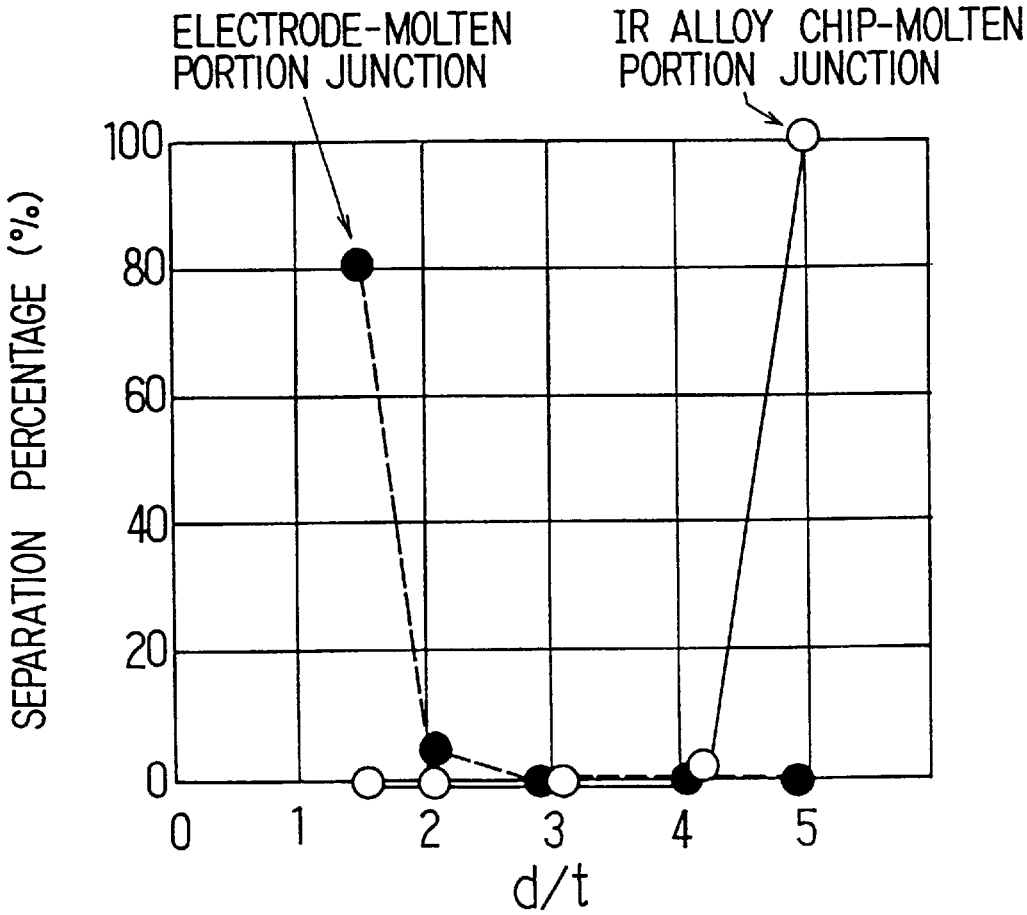
FIG. 5B is a graph showing the relationship between the separation percentage and the ratio of d/t at the respective electrode-molten portion junction and chip-molten portion junction.

FIG. 5B shows the relationship between the separation percentage and the ratio of d/t at the respective electrode-molten portion junction and chip- molten portion junction. Black circles represent the electrode-molten portion junction and white circles represent the chip- molten portion junction. In case of the electrode-molten portion junction, the bonding strength is satisfied without the crack and the separation, unless the ratio of d/t is not less than 2. On the other hand, in case of the chip- molten portion junction, the bonding strength is satisfied, unless the ratio of d/t is not more than 4. Therefor, it is preferable that the ratio of d/t is $2 \leqq d/t \leqq 4$.

It is presumed that the separation took place due to the great difference of linear expansion co-efficient between the molten portion 70 and the ground electrode 4, as Ir content (about 85 weight percent) at the molten portion 70 is too high in case of d/t=1.5, as shown in FIGS. 4A and 4B. It is presumed, on the other hand, that the separation took place due to the great difference of linear expansion co-efficient between the molten portion 70 and the Ir alloy chip 52, as Ir content (about 15 weight percent) at the molten portion 70 is insufficient in case of d/t=5. To this end, it is preferable for ensuring the bonding strength that, within the above mentioned range of d/t, the Ir content at the molten portion 70 falls within the range from 20 weight percent to 80 weight percent, under the presumption that the sum of Ir content and Ni content is 100 weight percent.

Figure 6A:
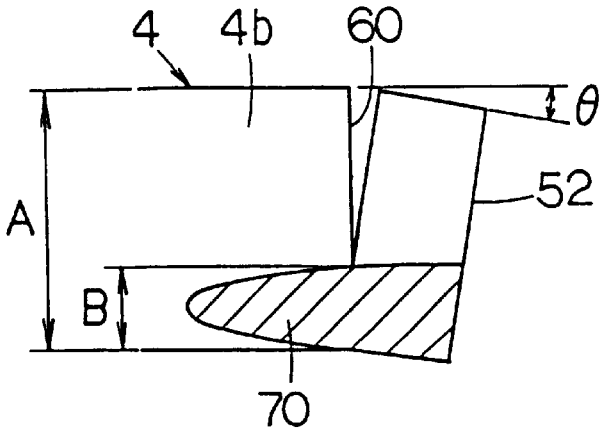
FIG. 6A is a drawing for explaining the separation angle of the chip.
Figure 6B:
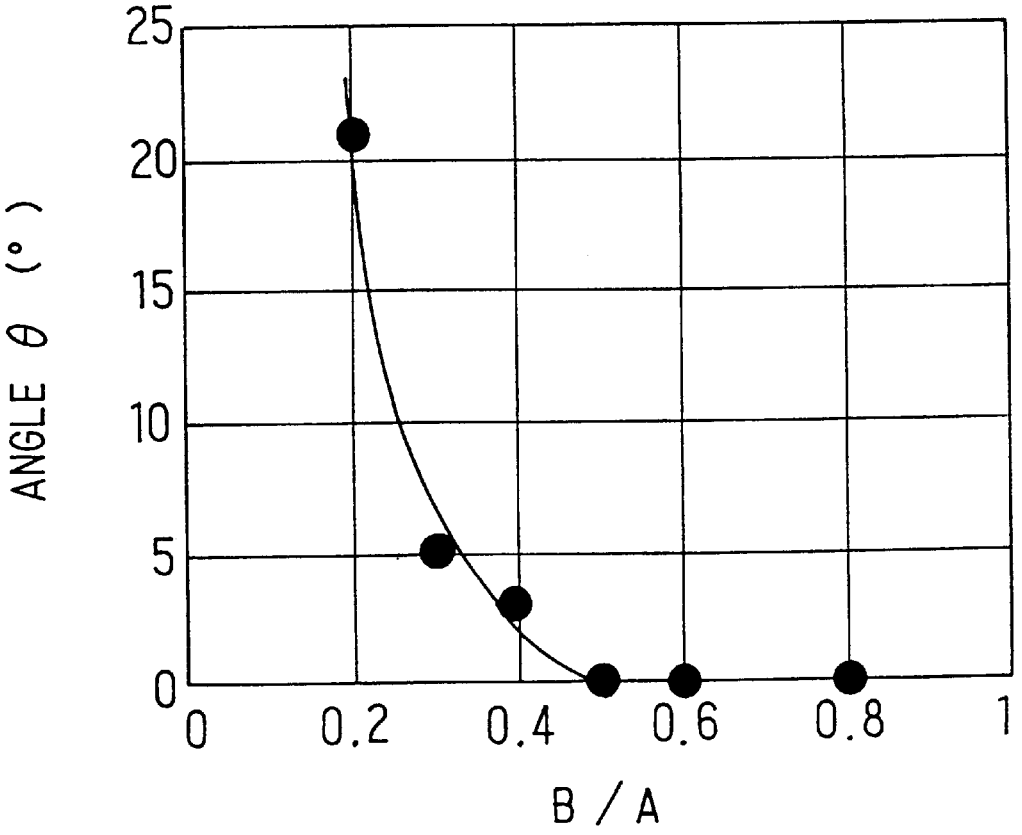
FIG. 6B is a graph showing the relationship between the ratio of B/A and the separation angle.

FIGS. 6A and 6B show the result of the endurance test similar as mentioned above with respect to the test samples made by changing the ratio of B/A under the fixed condition of the ratio of d/t=3. The bonding strength is evaluated by an angle θ by which the chip 52 is separated from the junction 60, as shown in FIG. 6A. Unless the ratio of B/A is not less than 0.5, the bonding strength is satisfied without the inclination of the chip 52 as shown in FIG. 6B. If the ratio of B/A is too small, the chip 52 is separated and inclined due to the thermal stress, as the bonding of the chip 52 mainly rely upon the tentative resistance welding, so that an adequate discharge gap to the center electrode 3 may not be maintained.

According to the present embodiment, the configuration of the molten portion 70 satisfies $B/A \geqq 0.5$ so that the separation of the chip 52 from the ground electrode at the junction 60 due to the thermal stress may be prevented. Further, as $2 \leqq d/t \leqq 4$ is also satisfied, the separation of the chip 52 from the molten portion 70 and the separation of the molten portion 70 from the ground electrode 4 due to the thermal stress can be prevented. Thus, the configuration of the molten portion having a high bonding reliability against the thermal stress may be realized.

Figure 7A:
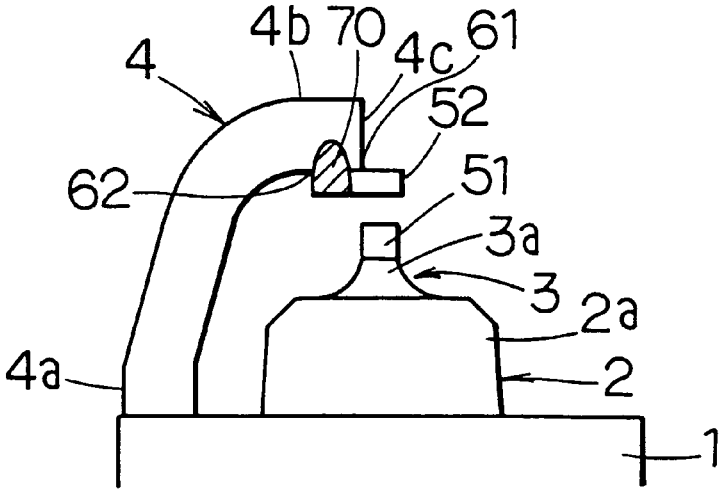
FIG. 7A is a partial view of the spark plug according to a second embodiment.
Figure 7B:
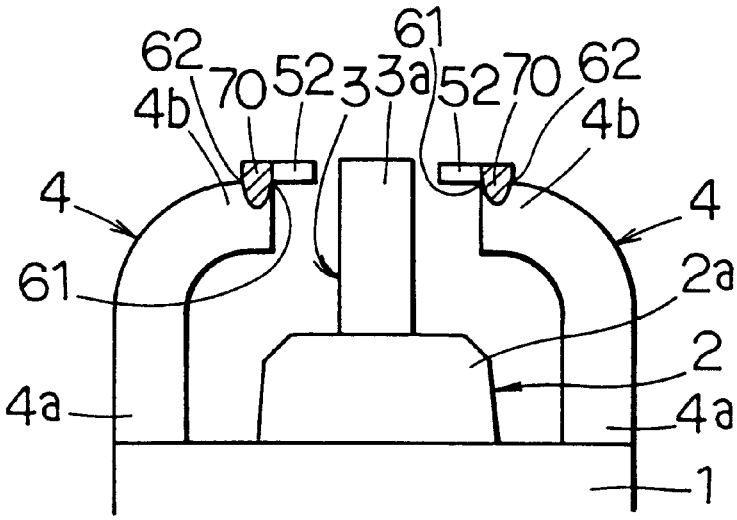
FIG. 7B is a partial view of the spark plug according to a third embodiment.

FIGS. 7A, 7B, 8A, 8B, 9A, 9B and 9C show second to sixth embodiments of the present invention. In FIG. 7A, a part of the longitudinal side surface of the column shaped chip 52 is bonded by the laser beam welding on an inner surface of the leading end 4*b* of the ground electrode 4 facing the leading end 3*a* of the center electrode 3 according to the second embodiment. In FIG. 7B, a pair of the ground electrodes 4 respectively fixed on the housing 1 face the side surface of the leading end 3*a* of the prolonged center electrode 3 and respective longitudinal side surface of a pair of the pillar shaped chips 52 are bonded by the laser beam welding on the respective outer surfaces of the leading ends 4*b* of the ground electrodes 4 according to the third embodiment. The molten portion 70, not viewed on the outside appearance, is shown with hatching in FIGS. 7A and 7B and in FIGS. 8A, 8B, 9B and 9C, too.

Figure 8A:
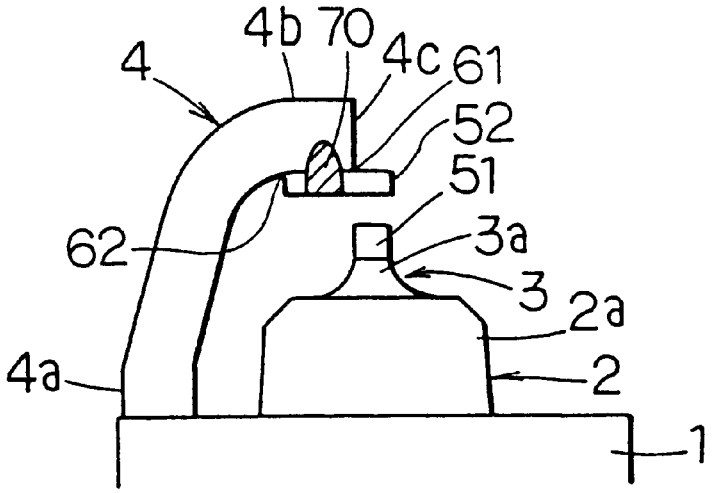
FIG. 8A is a partial view of the spark plug according to a fourth embodiment.
Figure 8B:
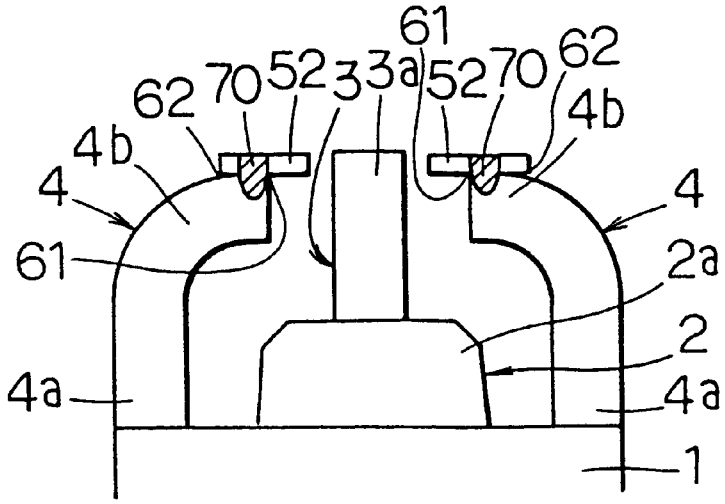
FIG. 8B is a partial view of the spark plug according to a fifth embodiment.

Though FIGS. 7A and 7B show the embodiments where the first non-molten portion mentioned above does not exist, the first non-molten portion may exist as shown in FIGS. 8A and 8B as fourth and fifth embodiments.

Figure 9A:
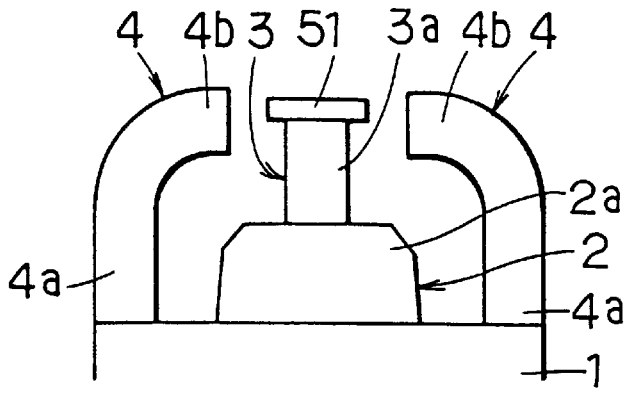
FIG. 9A is a partial view of the spark plug according to a sixth embodiment.
Figure 9B:
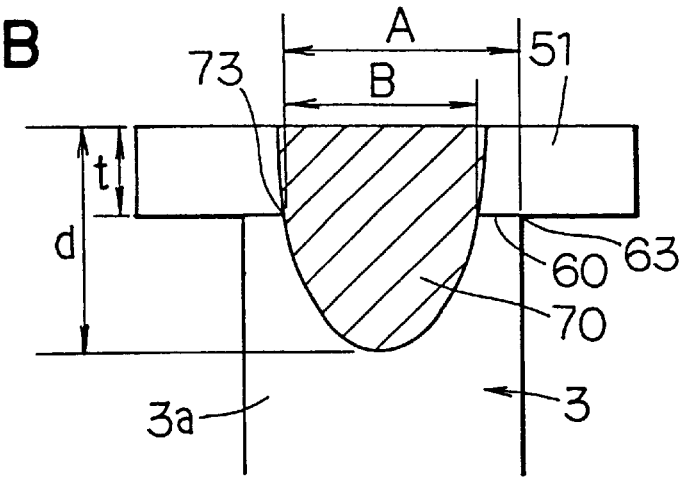
FIG. 9B is an enlarged view of the welding portion of the chip in FIG. 9A.
Figure 9C:
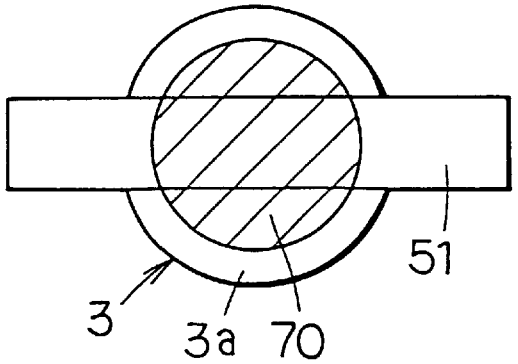
FIG. 9C is a drawing viewed from the upper side in FIG. 9B.

FIGS. 9A, 9B and 9C show a sixth embodiment where a longitudinal side surface of a pillar typed chip 51 is bonded by the laser beam welding on the end surface of the leading end 3*a* of the center electrode 3 under the similar position arrangement of the center and the pair of the ground electrodes as shown in FIGS. 7*b* and 8*b*. FIG. 9B shows an enlarged view of the welding portion of the chip 52*a*. FIG. 9C is a drawing viewed from the upper side in FIG. 9B.

According to the sixth embodiment shown in FIG. 9B, the lengths A and B mentioned above are shown under the relation with the ground electrode 4 on the right side (hereinafter called right side ground electrode 4) described in FIG. 9A. That is, the maximum length A is the longest length among the lengths of various straight lines connecting the end 63 of the junction 60 on the side of the right side ground electrode 4 and the end 73 of the molten portion 7 on the junction on the side opposite to the right side ground electrode 4. the molten portion length B is a length of the molten portion 70 within the maximum length A.

The relationship between the lengths A and B is same under the relation with the ground electrode 4 on the left side described in FIG. 9A. In the spark plug according to the sixth embodiment described in FIGS. 9A, 9B and 9C, each dimension of A, B, d and t is defined as mentioned in the first embodiment so that the high bonding reliability against the thermal stress at the molten portion of the center electrode 3 may be realized. It goes without saying that the construction described in FIGS. 9A, 9B and 9C may be combined with the construction described in FIG. 7B or 8B.

The shape of the chip 51 or 52 is not limited in the column, but may be a square pillar or a disk. However, it is preferable to have the thickness adequate for the laser beam welding, that is, to have a protruding length t from the junction sufficient for forming the molten portion 70.

Figure 10:
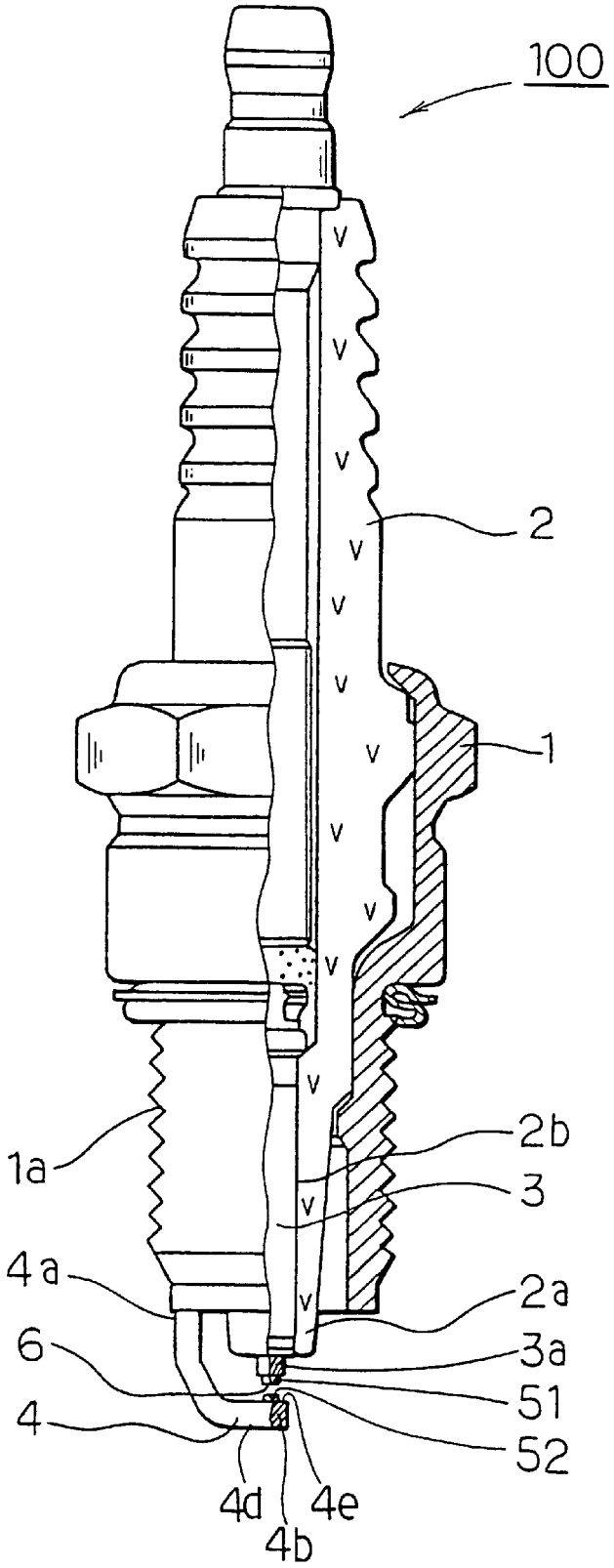
FIG. 10 is a semi cross sectional view of a spark plug according to a seventh embodiment of the present invention.

Next, a seventh embodiment according to the present invention will be described. FIG. 10 shows a semi cross sectional view of a spark plug for an internal combustion engine according to a seventh embodiment. The seventh embodiment is similar to the first embodiment described in FIG. 1 except that, according to the seventh embodiment, an end surface of a column type chip 52 is bonded on an inner surface 4*e* of the leading end 4*b* of the ground electrode 4, though the longitudinal side surface of the column type chip 52 is bonded on the end surface 4*c* of the leading end 4*b* of the ground electrode 4 according to the first embodiment.

Figure 11A:
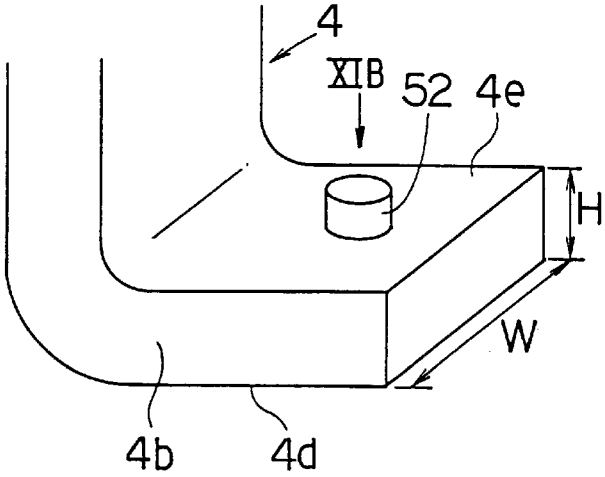
FIG. 11A is a partly enlarged diagonal appearance view showing a leading end of the ground electrode in FIG. 10.
Figure 11B:
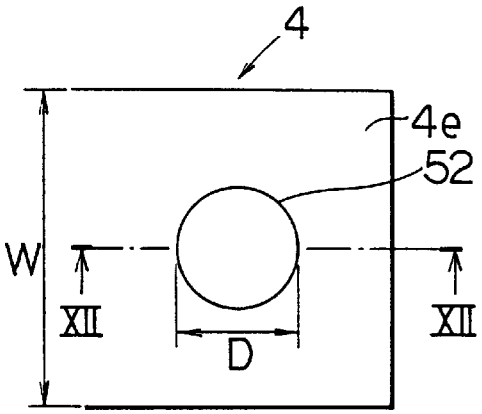
FIG. 11B is an appearance view taken from an arrow XIB in FIG. 11A.
Figure 12:
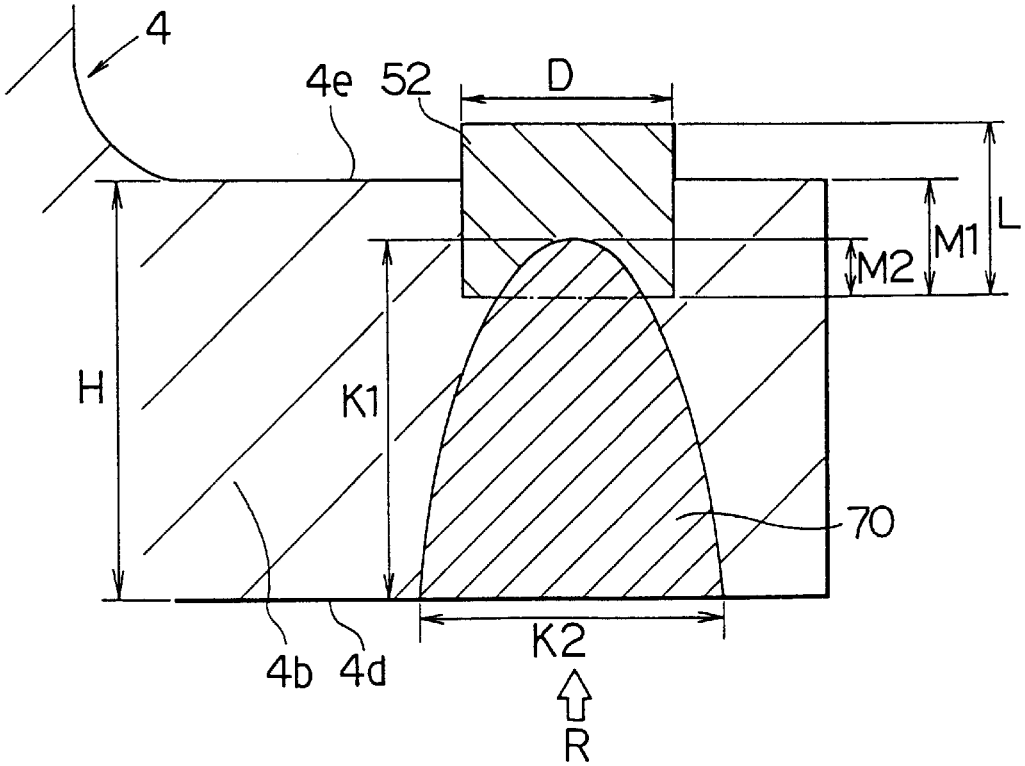
FIG. 12 is a cross sectional view taken along a line XII-XII in FIG. 11B.

With respect to the chip 52 that is a gist of the seventh embodiment, the details will be described below according to FIGS. 11A, 11B and 12. FIG. 11A is a partly enlarged diagonal appearance view showing a leading end 4*b* of the ground electrode 4, FIG. 11B is an appearance view taken from an arrow XIB in FIG. 11A and FIG. 12 is a cross sectional view taken along a line XII—XII in FIG. 11B. The chip 52 is shaped as a column similar to a disk, in which the diameter D is about 0.7 mm and the length L is about 0.6 mm. A longitudinal part of the column shaped chip 52 is buried into the inner surface 4*e* of the leading end 4*b* of the ground electrode 4 (for example, the width W is 2.6 mm and the thickness H is 1.4 mm in case of the ground electrode 4). The buried depth of the chip 52 is, for example, 0.5 mm.

The molten portion 70 comprised of the alloy containing Ni and Ir as base compositions, which is constituted by the material melting of the chip 52 and the ground electrode 4, are formed from the outer surface 4*d* (on the side opposite to the inner surface 4*e*) of the leading end 4*b* through the inside of the ground electrode 4 into a part of the inside of the chip 52. The molten portion 70 is shaped nearly as a semi ellipse and the thickness (length on a minor axis of the semi ellipse) is thickest at the outer surface 4*d* and becomes thinner toward the inner surface 4*e*, as shown in FIG. 12. With respect to dimensions of the molten portion 70 described in FIG. 12, for example, a length K1 of the molten portion 70 along the thickness H direction of the ground electrode 4 is about 1.1 mm and a length M2 of the molten portion 70 invading into the chip 52 is about 0.2 mm. A length k2 of the molten portion 70 on the outer surface 4*d* of the ground electrode 4 is about 1.0 mm.

As a method for bonding the chip 52 on the electrode 4, the chip 52 is put and tentatively fixed at first on the inner surface 4*e* of the ground electrode 4 before conducting a laser beam welding. To fix tentatively, a resistance welding may be conducted by pressing the chip 52 toward the inner surface 4e in use of tools and jigs so that a part of the chip 52 may be buried into the ground electrode 4. As the conditions of the resistance welding, 30 kgf load and 850 A (ampere) current may be used, for example.

The reason why the chip 52 is partly buried into the inner surface 4*e* at the resistance welding is that the ground electrode 4 become softer and is dented since the melting point of the ground electrode 4 made of Ni base alloy is about 1500 to 1600° C. and that of the chip 52 made of Ir alloy is about 2500° C. For the easy installation of the chip 52 on the ground electrode 4, a hollow or a groove for adequately positioning the chip 52 may be provided in advance on the inner surface 4*e*.

Next, the laser beam welding is conducted from the direction shown in an arrow R in FIG. 12. The laser beam welding conditions are, for example, 60 J energy (20 msec pulse width and 420 V charging voltage), +2 mm defocus and 0.4 mm laser beam diameter. When the laser beam is continuously radiated (for example 3 times) under the conditions mentioned above, the molten portion 70 mentioned above is formed and the ground electrode 4 and the chip 52 are bonded.

According to the seventh embodiment, as the molten portion 70, which is not good at the consumption resistance, is not formed on the spark discharge surface of the chip 52 since the laser beam welding is conducted from the outer surface 4*d* of the ground electrode 4 opposite to the spark discharge surface, the longer life and high performance of the spark plug may be realized.

Further, The spark plug according to the seventh embodiment can be manufactured at the inexpensive cost because the amount of the noble metal to be used is minimized and the conventional bore in the ground electrode, into which the chip is inserted and bonded by welding, is not necessary.

The shape of the chip 52 according to the seventh embodiment is not limited to the column mentioned above, but may be various shapes as shown in FIGS. 13A to H. Each of FIG. 13B, FIG. 13D, FIG. 13F and FIG. 13H shows a cross sectional view taken along respective lines of XIIIB—XIIIB in FIG. 13A, XIIID—XIIID in FIG. 13C, XIIIF—XIIIF in FIG. 13E and XIIIF—XIIIF in FIG. 13G. It will be clearly understood how the molten portion 70 is invaded into the chip 52 from these FIGS.

Figure 13A:
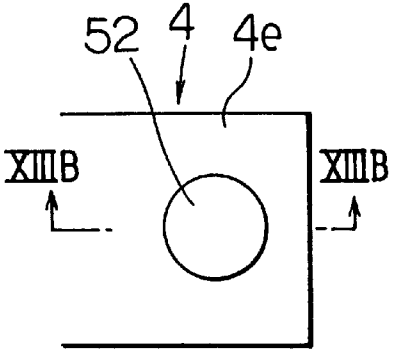
FIG. 13A is a view of a first variation according to the seventh embodiment.
Figure 13B:
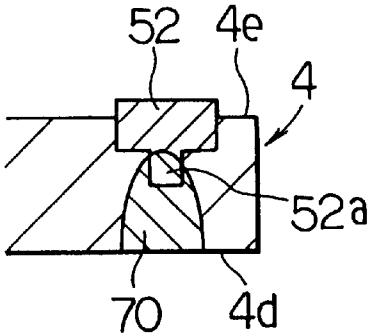
FIG. 13B is a cross sectional view taken along a line of XIIIB—XIIIB in FIG. 13A.
Figure 13C:
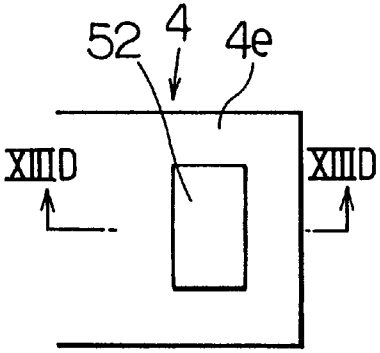
FIG. 13C is a view of a second variation according to the seventh embodiment.
Figure 13D:
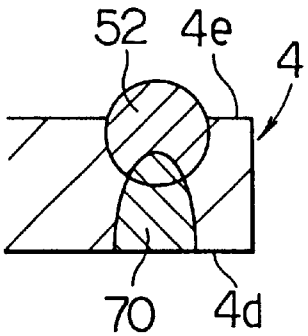
FIG. 13D is a cross sectional view taken along a line of XIIID—XIIID in FIG. 13C.
Figure 13E:
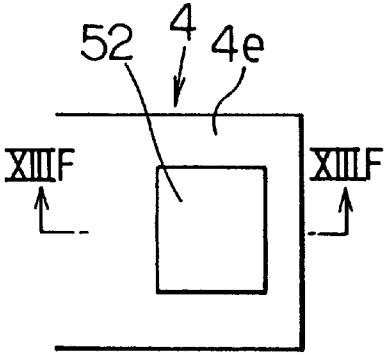
FIG. 13E is a view of a third variation according to the seventh embodiment.
Figure 13F:
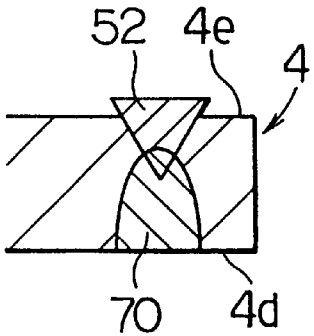
FIG. 13F is a cross sectional view taken along a line of XIIIF—XIIIF in FIG. 13E.
Figure 13G:
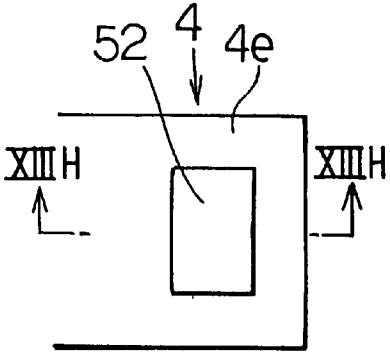
FIG. 13G is a view of a fourth variation according to the seventh embodiment.
Figure 13H:
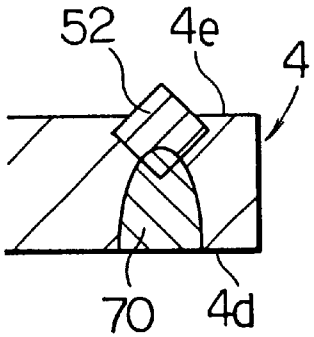
FIG. 13H is a cross sectional view taken along a line of XIIIH—XIIIH in FIG. 13G.

The chip 52 in FIGS. 13A and 13B is shaped as a column having a leg portion 52*a* protruding from the side surface of the chip 52 buried into the inner surface 4*e* of the ground electrode 4. The chip 52 in FIGS. 13C and 13D is shaped as a column, a longitudinal side surface of which is buried into the inner surface 4*e*. The chip 52 in FIGS. 13E and 13F is shaped as a triangular pillar and the chip 52 in FIGS. 13G and 13H is shaped as a square pillar, where each longitudinal ridgeline of the pillars is nearly parallel to the inner surface 4*e*.

According to the above mentioned embodiments, the longer life of the spark plug can be expected, as the replacement interval of the spark plug is prolonged to a large extend because of the high bonding reliability mentioned above. The above spark plug may be applicable under the severe heat load environment. Further, the laser beam welding according to the present embodiment makes the bonding of the chip very easy, compared with the resistance welding in which the pressure has to be apply to the chip, so that the manufacturing cost may be lowered. However, the other welding method such as an argon or arc welding may be employed instead of the laser beam welding, if the molten portion mentioned above is sufficiently formed.

Further, material of chip 51 or 52 is not only the Ir-10Rh alloy containing 90 weight percent Ir and 10 weight percent Rh, but also any Ir alloy containing Ir as a base composition and at least any one composition of Pt, Ru, Pd and Rh such as an Ir—Rh—Pt alloy. Furthermore, material of the center and/or ground electrode is not limited to the Ni base alloy, but any material having a good heat resistance.

What is claimed is:

1. A spark plug comprising:

a center electrode having a leading end;

a housing holding, but insulated with, the center electrode;

a ground electrode fixed to the housing and having a leading end which faces the leading end of the center electrode with a gap space, wherein at least one of the leading ends of the ground and center electrodes is a subject leading end and the other one of the leading ends of the ground and center electrodes is an opponent leading end, a shortest gap between the subject and opponent leading ends defining a spark discharge gap;

a noble metal chip partly buried into and bonded to the subject leading end so as to define a junction between contacting surfaces of the chip and the subject leading end, and wherein a first surface part of the chip is a spark discharge surface exposed directly to the spark discharge gap; and a molten portion made of a molten mixture of materials of the chip and the subject leading end and extending from a second surface part of the chip through an inside of the chip, through the junction, and into an inside of the subject leading end in such a manner that a cross-sectional area of the molten portion is gradually narrower from said second surface part of said chip toward the subject leading end, wherein the molten portion is not formed on the first, spark discharge surface part of the chip, and wherein a ratio of B/A is not less than 0.5, where A is a maximum length from the end of the junction on the side of the opponent leading end to the end of the molten portion on the junction on the side opposite to the opponent leading end and, within the length A, B is a length of both ends of the molten portion, and a ratio of d/t is not less than 2, but not more than 4, where t is a length of the chip perpendicularly extending from the junction and d is a sum of the length t and a length of the molten portion protruding from the junction into the subject leading end.

2. A spark plug according to claim 1, wherein the chip is made of an Ir alloy, the subject leading end is made of a Ni base alloy and the molten portion is a Ir—Ni alloy formed by a laser beam welding.

3. A spark plug according to claim 2, wherein the chip is made of an Ir alloy containing at least any one of Pt, Ru, Pd and Rh.

4. A spark plug according to claim 2, wherein an Ir content of the molten portion is 20 to 80 weight percents under the presumption that the sum of the Ir and Ni contents is 100 weight percents.

5. A spark plug according to claim 1, wherein the chip is shaped as a pillar bonded on the subject leading end to constitute the junction therebetween.

6. A spark plug according to claim 5, wherein the leading end of the ground electrode has an end surface, an inner surface and an outer surface opposite to the inner surface, the chip has a longitudinal side surface and both end surfaces and the longitudinal side surface of the chip is bonded on any one of the end surface, the inner surface and the outer surface of the leading end of the ground electrode so that at least one of the end surfaces of the chip constitutes the spark discharge surface.

7. A spark plug according to claim 5, wherein the leading end of the center electrode has an end surface, the chip has a longitudinal side surface and both end surfaces and the longitudinal side surface of the chip is bonded on the end surface of the leading end of the center electrode so that at least one of the end surfaces of the chip constitutes the spark discharge surface.

8. A spark plug comprising:

a center electrode having a leading end;

a housing holding, but insulated with, the center electrode;

a ground electrode fixed to the housing and having a leading end, the leading end of the ground electrode having an end surface, an inner surface and an outer surface on a side opposite to the inner surface, wherein the inner surface of the leading end of the ground electrode faces the leading end of the center electrode with a gap, the gap between the leading end of the center electrode and the inner surface of the leading end of the ground electrode, whose distance is shortest, constituting a spark discharge gap;

a noble metal chip bonded to the inner surface of the leading end of the ground electrode so as to constitute a junction between contacts of the chip and the inner surface of the leading end of the ground electrode, wherein a part of the chip is exposed directly to the spark discharge gap to constitute a spark discharge surface; and a molten portion made of a molten mixture of materials of the chip and the leading end of the ground electrode and extending from the outer surface through inside of the leading end of the ground electrode and the junction into inside of the chip on a side opposite to the spark discharge surface in such a manner that a cross sectional area of the molten portion is gradually narrower toward the chip.

9. A spark plug according to claim 8, wherein the thickness of the molten portion is thickest at the outer surface of the leading end of the ground electrode and becomes thinner toward the inner surface of the leading end of the ground electrode.

10. A spark plug according to claim 8, wherein the chip is made of an Ir alloy, the leading end of the ground electrode is made of a Ni base alloy and the molten portion is a Ir—Ni alloy.

11. A method for manufacturing a spark plug that comprises:

a center electrode having a leading end;

a housing holding, but insulated with, the center electrode;

a ground electrode fixed to the housing and having a leading end, the leading end of the ground electrode having an end surface, an inner surface and an outer surface on a side opposite to the inner surface, wherein the inner surface of the leading end of the ground electrode faces the leading end of the center electrode with a gap, the gap between the leading end of the center electrode and the inner surface of the leading end of the ground electrode, whose distance is shortest, constituting a spark discharge gap;

a noble metal chip bonded to the inner surface of the leading end of the ground electrode so as to constitute a junction between contacts of the chip and the inner surface of the leading end of the ground electrode, wherein a part of the chip is exposed directly to the spark discharge gap to constitute a spark discharge surface; and a molten portion made of a molten mixture of materials of the chip and the leading end of the ground electrode and extending from the outer surface through inside of the leading end of the ground electrode and the junction into inside of the chip on a side opposite to the spark discharge surface in such a manner that a cross sectional area of the molten portion is gradually narrower toward the chip, the method comprising the steps of:

mounting the chip on the inner surface of the leading end of the ground electrode; and bonding the chip and the ground electrode by radiating a laser beam from a side of the outer surface of the leading end of the ground electrode.

12. A method for manufacturing the spark plug according to claim 11, further comprising the steps of:

tentatively fixing the chip on the ground electrode after mounting the chip on the inner surface of the leading end of the ground electrode by resistance welding but before radiating the laser beam to form the molten portion.

13. A method for manufacturing the spark plug according to claim 12, further comprising the steps of:

pressing the chip toward the inner surface of the leading end of the ground electrode on conducting the resistance welding so that a part of the chip is buried into the ground electrode.

* * * * *